3/25/80 OR 4,194,570

United States Patent [19]

Arencibia, Jr.

[11] 4,194,570

[45] Mar. 25, 1980

[54] FLOW MOMENTUM REVERSING FIRE ABATEMENT SYSTEM

[75] Inventor: Jose P. Arencibia, Jr., Bethlehem, Pa.

[73] Assignee: Air Products & Chemicals, Inc., Allentown, Pa.

[21] Appl. No.: 965,817

[22] Filed: Dec. 4, 1978

[51] Int. Cl.[2] ..... A62C 3/04

[52] U.S. Cl. ..... 169/46; 166/90; 169/54; 169/69

[58] Field of Search ..... 169/9, 11, 46, 47, 54, 169/60, 61, 69; 166/90, 362, 364

[56] References Cited

U.S. PATENT DOCUMENTS

| | | | |
|---|---|---|---|
| 1,521,390 | 12/1924 | Reynolds | 166/90 X |
| 1,640,839 | 8/1927 | Kliewer | 169/69 X |
| 3,620,299 | 11/1971 | Wiseman, Jr. | 169/69 X |

*Primary Examiner*—Joseph J. Rolla
*Assistant Examiner*—Fred A. Silverberg
*Attorney, Agent, or Firm*—E. Eugene Innis; William F. Marsh

[57] ABSTRACT

Disclosed is an apparatus and method for extinguishing fires consuming combustible fluids, particularly gaseous fluids, issuing from wells, pipes or vent stacks. The apparatus comprises an extinguisher body typically having a cylindrical passageway which is connected in inline flow relationship with the well, pipe or vent stack and through which the flow of combustible fluid must pass. A diffuser cone is mounted within the extinguisher body passageway in coaxial alignment, the apex of the cone directed towards the outlet of the extinguisher body. An extinguisher fluid nozzle is mounted within the extinguisher body passageway for directing a flow of high momentum inert gas against the apex of the conical diffuser. High momentum inert gas is supplied to the nozzle when it is required to extinguish a fire consuming the combustible fluid passing through the extinguisher body and out of the well, pipe or vent stack. The high momentum flow of inert gas directed against the apex of the cone effectively blocks the flow of the combustible fluid through the extinguisher body while purging the combustible fluid from the extinguisher body to the outlet of the well, pipe or vent stack. The invention has particular applicability to vent stacks connected to the ullage spaces of tanks containing cryogenically liquefied combustible fluids such as liquid hydrogen or liquefied natural gas.

7 Claims, 2 Drawing Figures

FLOW MOMENTUM REVERSING FIRE ABATEMENT SYSTEM

BACKGROUND OF THE INVENTION

1. Field of the Invention

This invention relates to an apparatus and method for extinguishing fires consuming combustible fluids issuing from conduits such as pipes, gas wells and vent stacks. These combustible fluids may be liquids or gases.

There are a variety of situations wherein a combustible fluid is conducted from a source through a pipe to an outlet of the pipe where there is the possibility of ignition of the combustible fluid and ensuing fire as the combustible fluid continues to flow. Notable examples are vent stacks communicating from the ullage space on tanks containing combustible fluids to a vapor disposal area. Specific examples are the vent stacks on mobile tank transports for both cryogenically liquefied flammable gases and normally liquid combustible fluids having a high vapor pressure, such as gasoline and propane.

A particularly acute problem occurs in the venting of gaseous hydrogen such as from the boiloff of a liquid hydrogen storage or transport tank. The mixture of venting hydrogen and atmospheric oxygen produces a mixture having an extremely low ignition energy level. It is not uncommon that hydrogen venting to the atmosphere from a vent stack will spontaneously ignite, resulting in a very high temperature, virtually invisible flame. The low ignition energy, the high diffusivity and flame front velocities of a hydrogen and oxygen mixture combine to make extinguishment of such a fire very difficult. Typically, neither cooling nor diluting the mixture will extinguish the flame. It is also often difficult to eliminate the supply of oxygen by blanketing at the exit of the vent stack with inert gases. Thus, to extinguish such a fire it is necessary to cut off the flow of fuel at least for a short period of time 2. Description of the Prior Art The prior art has generally relied upon mechanical means for blocking the flow of combustible fluid through the pipe to the exit point where it is burning. These mechanical means have included various types of block valves or, in the case of oil and gas wells, certain types of blowout preventers. Problems associated with these mechanical blocking means include speed of operation and reliability. A further problem is that the blocking action of the mechanical device essentially stops the flow of the combustible fluid downstream from the blocking device unless an additional purge is introduced. This can have the effect of allowing the flame front to move into the conduit or allowing pockets of combustible mixtures to remain in the conduit downstream of the block valve for extended periods of time. This can create an unsafe situation. Mechanical block valves may also jam closed at cryogenic temperatures or at high temperatures caused by the fire. This jamming may cause serious pressure buildup in the storage space after the fire has been successfully extinguished.

U.S. Pat. No. 1,640,839 to Kliewer discloses a fire extinguisher for oil wells which relies not on mechanical blocking but upon interruption of the combustible fluid flow by means of flat blankets or jets of large volumes of steam directed from circumferential slots across the flow passage. The introduction of a large volume of steam chokes off and dilutes the flow of gas or oil. According to the Kliewer teahings, large volumes of steam must be introduced to choke off the fuel flow. These large volumes may not be critical where steam in large volumes is readily available, but presents a problem either where such volumes are not available or in those instances in which an expensive extinguisher fluid is required, such as helium.

SUMMARY OF THE INVENTION

The present invention encompasses both extinguisher apparatus and method which provides an efficient and reliable method for interrupting the flow of a combustible fluid through a pipe and simultaneously purging the pipe downstream from the extinguisher apparatus by discharging a high momentum flow of inert extinguisher fluid in the pipe in an axial direction opposite to the flow of the combustible fluid and diffusing the extinguisher fluid radially against the walls of the conduit by means of a conical diffuser, thereby reversing the momentum of the flowing combustible fluid. Once the extinguisher fluid has exchanged its momentum to block the flow of combustible fluid, it flows downstream, thereby purging the pipe.

The device for extinguishing burning combustible fluids exiting from a pipe comprises an extinguisher body having a flow passageway (preferrably of cylindrical shape) from an inlet to an outlet end, both of which ends are adapted for coupling the extinguisher body in the pipe for passage of the entire flow of the combustible fluid through the extinguisher body; a conical diffuser coaxially mounted in the extinguisher body passageway with the apex of the conical diffuser oriented towards the outlet of the extinguisher body passageway; an extinguisher fluid nozzle coaxially mounted in the extinguisher body passageway for discharge of an extinguisher fluid towards the inlet end of the extinguisher body and against the apex and convex surface of the conical diffuser; and means for connecting a high momentum source of extinguisher fluid to the nozzle from outside of the extinguisher body.

The method for extinguishing burning combustible fluids discharging from the outlet end of a pipe substantially comprises discharging a stream of extinguisher fluid into the flow of combustible fluid through the pipe at a point upstream of the pipe outlet, the discharge of the stream of extinguisher fluid being in a direction opposite to the flow of combustible fluid coaxial with the pipe at the point of discharge and having a momentum greater than that of the flowing combustible fluid in the pipe at the point of discharge, and radially diffusing the stream of extinguisher fluid by means of a conical diffuser mounted coaxially within the pipe.

In operation, the flow of the combustible fluid is stopped and effectively blocked by the momentum of the extinguisher fluid while at the same time the introduction of the extinguisher fluid purges the pipe downstream of the extinguisher apparatus. Fuel flow is thus interrupted to the fire.

It is thus an object of the invention to provide an apparatus of simple mechanical construction which will reliably and effectively extinguish fires of combustible fluids exiting from a pipe.

It is further an object of the invention to provide a method for interrupting the flow of combustible fluids in a pipe and purging the pipe from the point of interruption to the outlet in order to extinguish fires of combustible fluids exiting from the pipe.

A further object is to provide both method and apparatus which can be effectively used with combustible fluids at cryogenic temperatures.

It is a further object of the invention to reduce the quantities of extinguisher fluid required for interruption of the flow of the combustible fluid through a pipe.

DETAILED DESCRIPTION OF THE INVENTION

Figure 1:
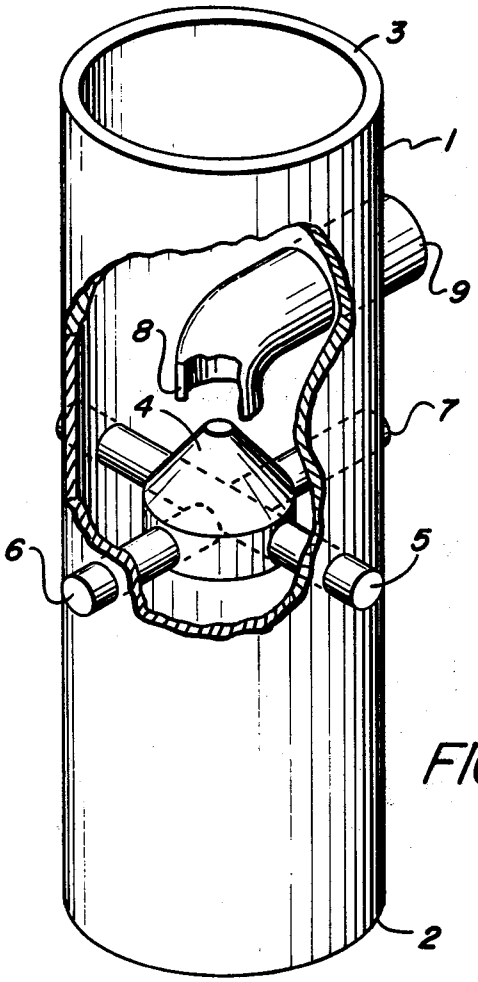
FIG. 1 is an isometric cutaway view of the extinguisher apparatus.

FIG. 1 shows the fire extinguisher apparatus which is to be connected in line with a pipe carrying a combustible fluid from a source to an exit point. The extinguisher body 1, having an inlet end 2 and an outlet end 3 has a substantially cylindrical bore or passageway from the inlet to the outlet end and generally consists of a length of pipe of the same construction as that into which it is to be connected. The inlet and outlet ends are adapted to be coupled in a fluid tight connection with the opposing ends of the combustible fluid pipe. This coupling may be by means of welding, flanged fittings, screw-type couplings or any other means commonly employed. A conical diffuser 4 is mounted within the extinguisher body bore in coaxial alignment with the apex towards the outlet end 3 of the extinguisher body. In a preferred embodiment, the conical diffuser is mounted by means of rod 5 which passes diametrically through the walls of the extinguisher body and the conical diffuser. Rods 6 and 7 also pass radially through the walls of the extinguisher body and radially into the conical diffuser. These rods may then be welded into place where they pass through the outside wall of the extinguisher body or may be otherwise fastened in place.

An extinguisher fluid nozzle 8 is mounted within the extinguisher body bore with the nozzle outlet coaxially aligned with both the extinguisher body bore and the conical diffuser, the discharge outlet of the nozzle being opposed to the apex of the conical diffuser. The nozzle is connected to a tube 9 which passes through the wall of the extinguisher body. In a preferred embodiment, the nozzle 8 and tube 9 are constructed from a single piece of tubing with a 90° bend. The tubing may be welded to the extinguisher body where it passes through the wall so as to support the nozzle in proper alignment within the extinguisher body.

Figure 2:
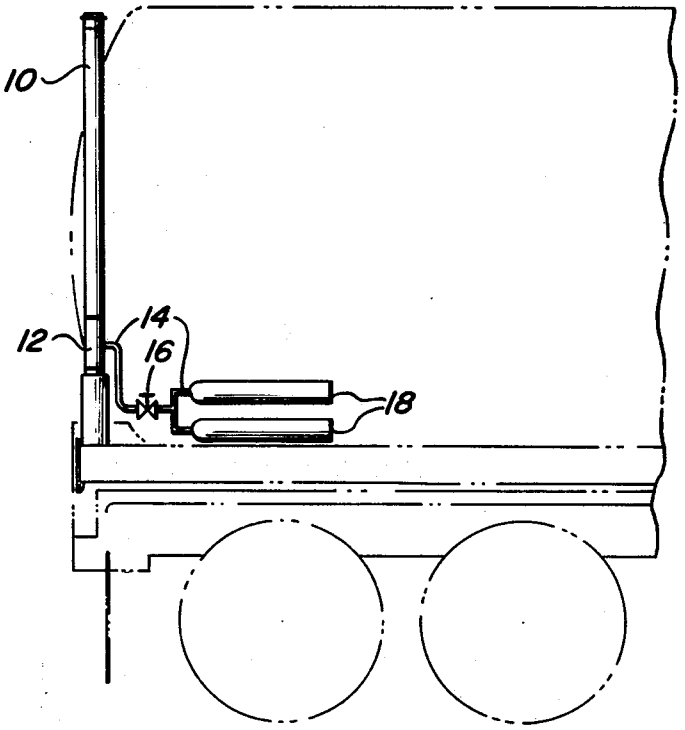
FIG. 2 shows the installation of the apparatus in a preferred embodiment in the vent stack of a cryogenic liquefied gas transport trailer of the type used for transporting liquefied natural gas or liquid hydrogen.

Referring now to FIG. 2, in a preferred embodiment, the extinguisher apparatus is connected in the vent stack of a tanker for transporting cryogenic liquefied gases such as natural gas or hydrogen. The vent stack 10 leads from the ullage space of the insulated storage tank to a point above the rear of the tank where the combustible gas vapors may be safely discharged. The extinguisher apparatus 12 is connected in the vent stack line. The extinguisher fluid nozzle is connected to a source of high pressure extinguisher fluid via line 14 and valve 16. In the case of a liquid hydrogen tanker, the extinguisher fluid is preferably helium stored in high pressure cylinders 18 carried on the tanker. Helium is used because of its inertness and because of its extremely low boiling point. Cold hydrogen which vaporizes at a temperature of about —258° C, would cause most other inert gases, such as nitrogen which has a melting point of —210° C., to solidify and thus block the vent stack, causing a potentially dangerous pressure buildup. In the case of combustible fluids having higher boiling points such as liquefied natural gas, less expensive extinguisher fluids such as nitrogen and carbon dioxide may be used.

Operation of the fire extinguisher apparatus is initiated by opening valve 16 to allow the extinguisher fluid to flow rapidly into the fire extinguisher apparatus. Alternatively valve 16 may be manually actuated or may be remotely or automatically actuated through conventional means in response to a signal from a fire detector mounted at the discharge of the vent stack.

While the apparatus and its operation have been described in the context of extinguishing burning gases exiting from the outlet of a vent stack on a liquid hydrogen or liquefied natural gas mobile transport tank, it will be obvious that the apparatus or the method can be used in many other situations such as natural gas wells, gasoline storage tank vent stacks and other vent and flare stacks. The apparatus and method are also applicable where the combustible fluid is exiting as a liquid. In such circumstances, proper design and selection of the extinguisher fluid will be well within the abilities of those skilled in the art utilizing the teachings of this disclosure.

What is claimed is:

1. A device for extinguishing combustible fluids exiting from a pipe which device comprises:

(a) an extinguisher body having inlet and outlet ends and passageway therebetween adapted for coupling the extinguisher body in the pipe for passage of the entire flow of the combustible fluid through the extinguisher body;

(b) a conical diffuser coaxially mounted in said extinguisher body with the apex of the conical diffuser oriented towards the outlet of the extinguisher body;

(c) an extinguisher fluid nozzle coaxially mounted in the extinguisher body between the conical diffuser and outlet end proximate the apex of the conical diffuser for discharge of an extinguisher fluid towards the inlet end of the extinguisher body and against the apex and convex surface of the conical diffuser; and (d) means for supplying a high momentum source of extinguisher fluid to the nozzle from outside of the extinguisher body.

2. The device of claim 1 wherein the means for supplying a high momentum source of extinguisher fluid to the extinguisher fluid nozzle comprises a pressurized cylinder of extinguisher fluid communicating with the nozzle through a valve.

3. The device of claim 2 wherein the valve is manually actuable to admit extinguisher fluid to the nozzle.

4. A method for extinguishing a burning combustible fluid exiting from the outlet end of a pipe which comprises interrupting the flow of combustible fluid to the outlet end of the pipe by:

discharging a stream of extinguisher fluid into the flow of combustible fluid through the pipe at a point upstream of the pipe outlet, the discharge of the stream of extinguisher fluid being in a direction opposite to the flow of combustible fluid and coaxial with the pipe at the point of discharge, and radially diffusing the stream of extinguisher fluid by means of a conical diffuser mounted coaxially within the pipe, the discharge stream of extinguisher fluid having a momentum greater than that of the flowing combustible fluid in the pipe.

5. The method of claim 4 wherein the combustible fluid is a gas and the extinguisher fluid is a gas.

6. The method of claim 4 wherein the combustible fluid is a liquid and the extinguisher fluid is a liquid.

7. The method of claim 5 wherein the combustible fluid is hydrogen gas and the extinguisher fluid is helium gas.

* * * * *